US012137761B1

(12) United States Patent
Mulfeld

(10) Patent No.: US 12,137,761 B1
(45) Date of Patent: Nov. 12, 2024

(54) BELT INCLUDING A BELT STRAP FREE OF THROUGH HOLES CONFIGURED TO PREVENT INADVERTENT DISENGAGEMENT FROM A BELT BUCKLE

(71) Applicant: Stanley Mulfeld, New York, NY (US)

(72) Inventor: Stanley Mulfeld, New York, NY (US)

( * ) Notice: Subject to any disclaimer, the term of this patent is extended or adjusted under 35 U.S.C. 154(b) by 0 days.

(21) Appl. No.: 18/664,134

(22) Filed: May 14, 2024

(51) Int. Cl.
*A42B 1/00* (2021.01)
*A41F 9/00* (2006.01)
*A42B 1/0188* (2021.01)

(52) U.S. Cl.
CPC ..... *A41F 9/002* (2013.01); *A42B 1/0188* (2021.01)

(58) Field of Classification Search
CPC ..... A41F 9/002; A42B 1/0188
See application file for complete search history.

(56) References Cited

U.S. PATENT DOCUMENTS 4,669,155 A * 6/1987 Chen ..... A41F 9/002 24/191
4,733,440 A * 3/1988 Ogawa ..... A44B 11/12 24/579.11
5,572,747 A * 11/1996 Cheng ..... A44B 11/12 2/322
5,579,563 A * 12/1996 Sim ..... A44B 11/2592 24/615
6,067,661 A 5/2000 Bates
6,715,449 B1 * 4/2004 Jordan ..... A01K 27/005 24/DIG. 48
7,275,667 B2 10/2007 Bertucci
8,683,665 B2 * 4/2014 Fraze ..... A43C 11/1486 24/593.11
9,149,090 B1 * 10/2015 Taylor ..... A44B 11/006
9,277,776 B2 * 3/2016 Laatz ..... A41F 9/002
9,351,526 B1 * 5/2016 Taylor ..... A44B 11/125
9,918,522 B2 * 3/2018 Laatz ..... A44B 11/125
10,667,582 B2 * 6/2020 Hestvik ..... A44B 11/12
10,932,529 B2 * 3/2021 Mulfeld ..... A44B 11/006
(Continued)

FOREIGN PATENT DOCUMENTS

KR 90004717 Y1 7/1994

OTHER PUBLICATIONS

Smart Belt 3.0 YouTube Video accessible at https://www.indiegogo.com/projects/smart-belt-3-0-the-most-funded-accessory#/.

*Primary Examiner* — Richale L Quinn
(74) *Attorney, Agent, or Firm* — Merek, Blackmon & Voorhees, LLC

(57) ABSTRACT

A belt to secure an article worn by an individual. The belt includes a strap having a plurality of belt strap abutment portions configured to engage at least one buckle abutment portion of a corresponding buckle to prevent the strap from being inadvertently loosened. Preferably, the buckle abutment portion(s) is fixed and does not move. The belt strap includes an inadvertent disengagement prevention member ("IDPM") for preventing a corresponding belt strap abutment portion from inadvertently disengaging from the at least one buckle abutment portion of the belt buckle to prevent the inadvertent loosening of the adjustable belt strap when worn. The IDPM can take the form of one, two or more metal strips or plates. Preferably, one or more metal strips has a length no greater than 12", width of 0.5" and thickness of 0.007". The metal strips may be removable.

20 Claims, 10 Drawing Sheets

(56) References Cited

U.S. PATENT DOCUMENTS

| | | | | |
|---|---|---|---|---|
| 11,191,254 | B2 * | 12/2021 | Davis | A01K 27/001 |
| 11,805,855 | B1 * | 11/2023 | Soderberg | A43C 11/1453 |
| 11,864,638 | B2 * | 1/2024 | Kozak | A44C 5/2042 |
| 11,950,663 | B1 * | 4/2024 | Rowland | A44B 11/16 |
| 2020/0229546 | A1 * | 7/2020 | Coles | A44B 11/006 |

* cited by examiner

BELT INCLUDING A BELT STRAP FREE OF THROUGH HOLES CONFIGURED TO PREVENT INADVERTENT DISENGAGEMENT FROM A BELT BUCKLE

FIELD OF THE INVENTION

The present invention is directed to significant improvement in devices used by an individual to secure an article worn by an individual (e.g., pants, shorts, skirts, ornaments, etc.). Preferably, a belt strap lacking any through holes and a corresponding belt buckle are used to secure an article worn by an individual.

In a most preferred form, the corresponding belt buckle lacks any element or elements that move to lock or otherwise secure the belt strap in a desired position to secure an article worn by an individual to achieve significant advantages over prior art belts. These advantages include but are not limited to simplifying manufacture of the belt including the belt buckle, significantly reducing manufacturing costs of the belt including the belt buckle and significantly simplifying use of the belt including the belt buckle and belt strap.

Preferably, the belt strap of the present invention has no through holes and is configured to prevent inadvertent detachment from a corresponding belt buckle.

In a most preferred embodiment, the present invention is directed to an apparatus that completely eliminates the need for a belt buckle to have one or more moving members (i.e., one or more members that move relative to portions of the belt buckle) to securely connect a belt strap to a corresponding belt buckle at a position desired by an individual to prevent inadvertent loosening of the belt strap.

In a preferred embodiment, the belt strap includes an inadvertent disengagement prevention member ("IDPM") disposed adjacent an innermost portion of a non-metallic strip (e.g., plastic or nylon strip) having a plurality of belt strap abutment portions. The IDPM is configured to prevent inadvertent loosening of the belt strap. Specifically, the IDPM resists movement of a corresponding portion of the belt strap away from a corresponding portion of the belt buckle. Stated another way, the IDPM exerts a straightening force on a corresponding portion of belt strap to bias the corresponding portion of the belt strap toward a corresponding portion of the belt buckle to prevent inadvertent loosening of the belt strap even if the individual wearing the belt is engaged in strenuous activities.

In a most preferred form, the IDPM includes one or more metal strips which can be removed from the belt strap and replaced with other metal strips to vary or alter the straightening or biasing force of the IDPM. A removal facilitation member or element can be connected to the one or more of the metal strips to facilitate removal of the metal strip or strips.

In a most preferred embodiment, the IDPM is formed from high carbon spring steel and/or has a length of no greater than 12 inches, a thickness of 0.007 inches and a width of 0.5 inches. However, the IDPM can be configured with different lengths, thickness, widths and materials.

BACKGROUND OF THE INVENTION

Numerous belts including belts straps and belt buckles have been designed that are used to secure an article of clothing about a waist of an individual. Typically, the belt buckle includes a prong pivotally mounted on a buckle that penetrates a desired one of a plurality of holes or openings formed in and extending completely through a belt strap to secure the belt strap at a desired position relative to the belt buckle.

Various devices have been developed including those disclosed in U.S. Pat. Nos. 9,149,090; 9,351,525; and, 9,918,522 that do not use the well-known prong pivotally mounted on a buckle to penetrate a desired one of a plurality of through holes or openings formed in a belt strap to secure the belt strap at a desired position relative to the belt buckle. The belts of U.S. Pat. Nos. 9,149,090; 9,351,525; and, 9,918,522 require complex belt buckles that require a significant portion of the buckle itself to pivot (i.e., move relative to other portions of the buckle) to enable an individual to secure the belt strap in a desired position. These buckles also require a portion of the buckle that engages one or more teeth or protrusions formed on the inner surface of the belt strap to move with the release mechanism to allow an individual to loosen the belt strap.

While Applicant's U.S. Pat. No. 10,932,529 includes an extremely inventive device which does not require a significant portion of the buckle itself to pivot to enable an individual to secure the belt strap in a desired position, the belt strap can be inadvertently detached from a corresponding portion of the belt buckle resulting in inadvertent loosening of the belt strap.

Accordingly, the present invention is directed to preventing inadvertent detachment of the belt strap from a corresponding portion of the belt buckle thereby preventing inadvertent loosening of the belt strap.

OBJECTS AND SUMMARY OF THE INVENTION

An object of a preferred form of the present invention is to provide a novel and unobvious belt strap.

Another object of a preferred form of the present invention is to provide a belt strap that is configured to prevent inadvertent detachment of the belt strap having no through holes from a corresponding portion of a belt buckle.

A further object of a preferred form of the present invention is to provide a belt strap lacking any through holes having a portion of the belt strap configured to exert a force on or bias a corresponding portion of the belt strap into engagement with a corresponding portion of a belt buckle to prevent inadvertent detachment or disengagement of the belt strap from the corresponding belt buckle.

Another object of a preferred embodiment of the present invention is to provide one or more inadvertent disengagement prevention members configured to prevent inadvertent detachment of the belt strap from the belt buckle.

Still another object of a preferred form of the present invention is to provide one or more inadvertent disengagement prevention members that are disposed in a belt strap precluding one or more inadvertent disengagement prevention members from directly engaging/contacting any portion of a corresponding belt buckle.

Yet another object of a preferred form of the present invention is to provide one or more inadvertent disengagement prevention members that are disposed in a belt strap to prevent a corresponding portion of the belt strap from disengaging from a corresponding portion of the belt buckle wherein the one or more inadvertent disengagement prevention members are removable from the belt strap.

Another object of a preferred form of the present invention is to provide one or more inadvertent disengagement prevention members that are completely encased in belt strap so that the one or more inadvertent disengagement prevention members cannot be seen when the belt strap is worn.

A further object of a preferred form of the present invention is to provide one or more inadvertent disengagement prevention members that are completely encased in belt strap so that the one or more inadvertent disengagement prevention members never directly contact any portion of the belt buckle.

Yet a further object of a preferred form of the present invention is to provide a belt strap with an access/insertion/removal area that allows an individual to insert one or more additional inadvertent disengagement prevention members to supplement those presently existing in the belt strap, remove one or more existing inadvertent disengagement prevention members and/or replace one or more existing inadvertent disengagement prevention members with one or more additional or new inadvertent disengagement prevention members to vary a force exerted on the belt strap abutment portions.

Still a further object of a preferred form of the present invention is to provide a removal facilitation member secured to the one or more inadvertent disengagement prevention members to facilitate removal thereof.

It must be understood that no one embodiment of the present invention need include all of the aforementioned objects of the present invention. Rather, a given embodiment may include one or none of the aforementioned objects of the preferred forms of the invention. Accordingly, these objects are not to be used to limit the scope of the claims of the present invention. Further, the above is not an exhaustive list of the advantages and objects of the preferred forms of the present invention. Other advantages and objects of preferred forms of the present invention will be readily appreciated from the description of the preferred forms of the present invention.

In summary, one preferred embodiment of the present invention is directed to an apparatus for securing an article worn by an individual. The apparatus includes an adjustable belt strap having a first end and a second end wherein the first end forms a tip of the adjustable belt strap and the second end is configured to be connected to a portion of a belt buckle wherein the adjustable belt strap is free of any hole extending completely through the adjustable belt strap. The adjustable belt strap includes a plurality of belt strap abutment portions configured to engage at least one buckle abutment portion of the belt buckle to prevent the adjustable belt strap from being inadvertently loosened. The adjustable belt strap includes an inadvertent disengagement prevention member for preventing a corresponding belt strap abutment portion from inadvertently disengaging from the at least one buckle abutment portion of the belt buckle to prevent the inadvertent loosening of the adjustable belt strap when worn by an individual.

Another preferred embodiment of the present invention is directed to an adjustable belt for securing an article of clothing about a waist of an individual. The adjustable belt includes a belt strap including a free end, a connection end and an inner surface having a plurality of belt strap abutment portions and the belt strap being free of through holes. The adjustable belt further includes a belt buckle having at least one buckle abutment portion formed on a body of the belt buckle. The belt strap including an inadvertent disengagement prevention member for preventing inadvertent disengagement of one or more of the plurality of belt strap abutment portions from the at least one buckle abutment portion of the belt buckle by biasing the one or more of the plurality of belt strap abutment portions of the belt strap into engagement with the at least one buckle abutment portion of the buckle, wherein no portion of the inadvertent disengagement prevention member directly contacts any portion of the belt buckle.

A further embodiment of the present invention is directed to an apparatus that includes a belt strap having a first end and a second end wherein the first end forms a tip of the belt strap and the second end is configured to be connected to a portion of a belt buckle. The belt strap includes a plurality of belt strap abutment portions configured to engage at least one buckle abutment portion of the belt buckle so that the belt strap is maintained in a desired position when worn by an individual. The belt strap includes a metal strip for biasing the at least one of the plurality of belt strap abutment portions into engagement with the at least one buckle abutment portion of the belt buckle to prevent inadvertent loosening of the adjustable strap wherein the metal strip is disposed between an outermost surface of the adjustable belt strap and an innermost surface of the adjustable belt strap so that the metal strip does not directly contact any portion of the belt buckle when the belt strap is worn by an individual.

The above summary describes preferred forms of the present invention and is not in any way to be construed as limiting the claimed invention to the preferred forms.

DETAILED DESCRIPTION OF THE PREFERRED EMBODIMENTS OF THE INVENTION

Figure 1:
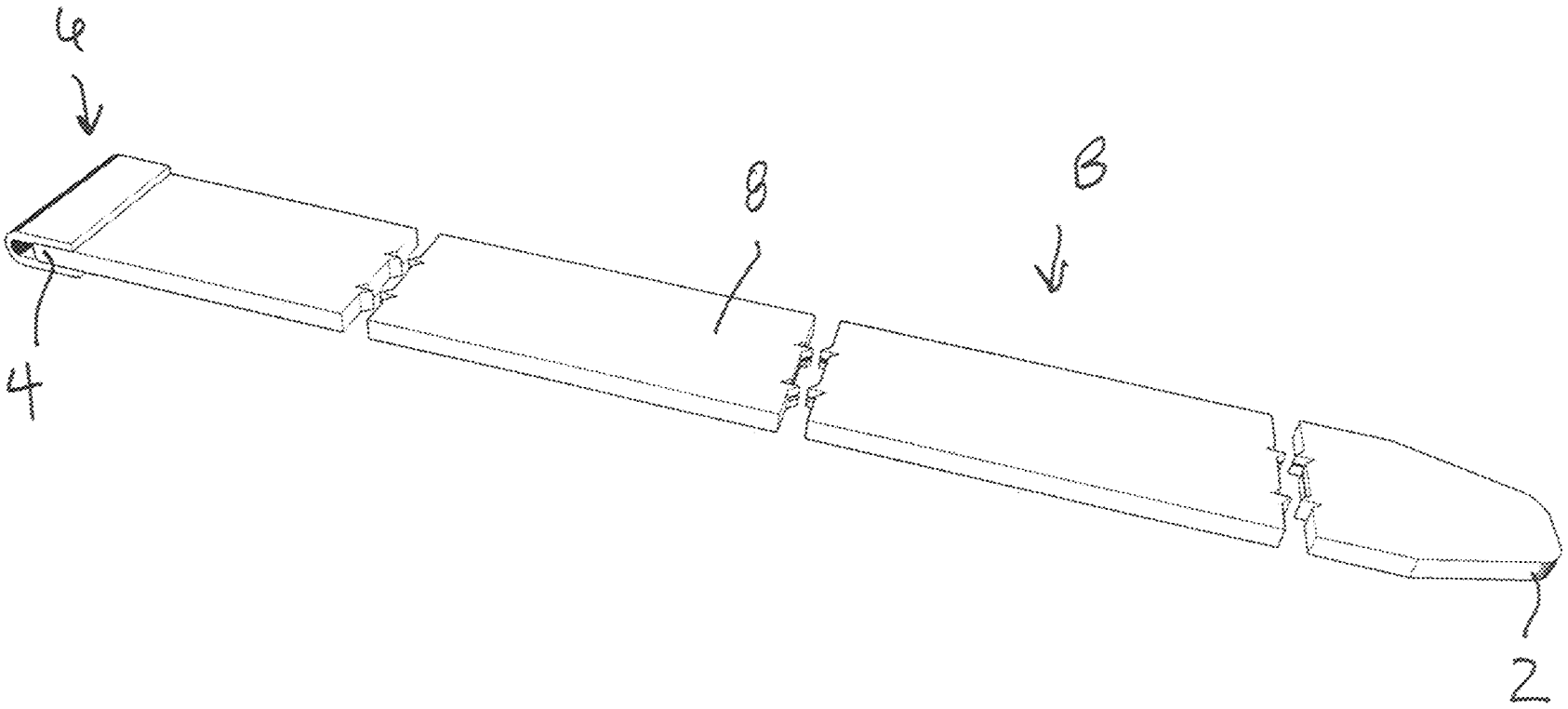
FIG. 1 is a fragmentary perspective view of a belt strap formed in accordance with one preferred embodiment of the present invention taken from a vantage point illustrating the outermost surface of the belt strap.
Figure 2:
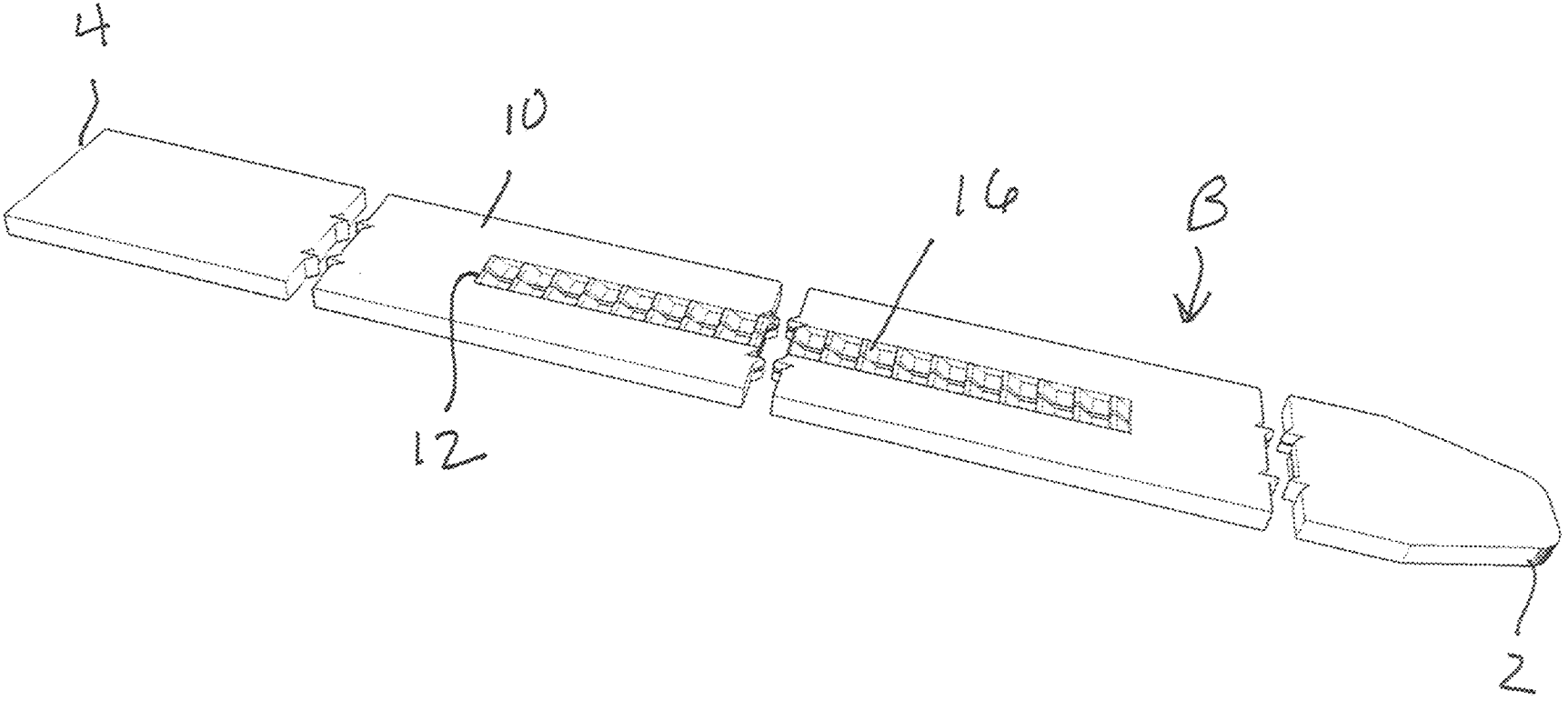
FIG. 2 is a fragmentary perspective view of a belt strap of FIG. 1 taken from a vantage point illustrating the innermost surface of the belt strap with the belt buckle connecting member being omitted.
Figure 3:
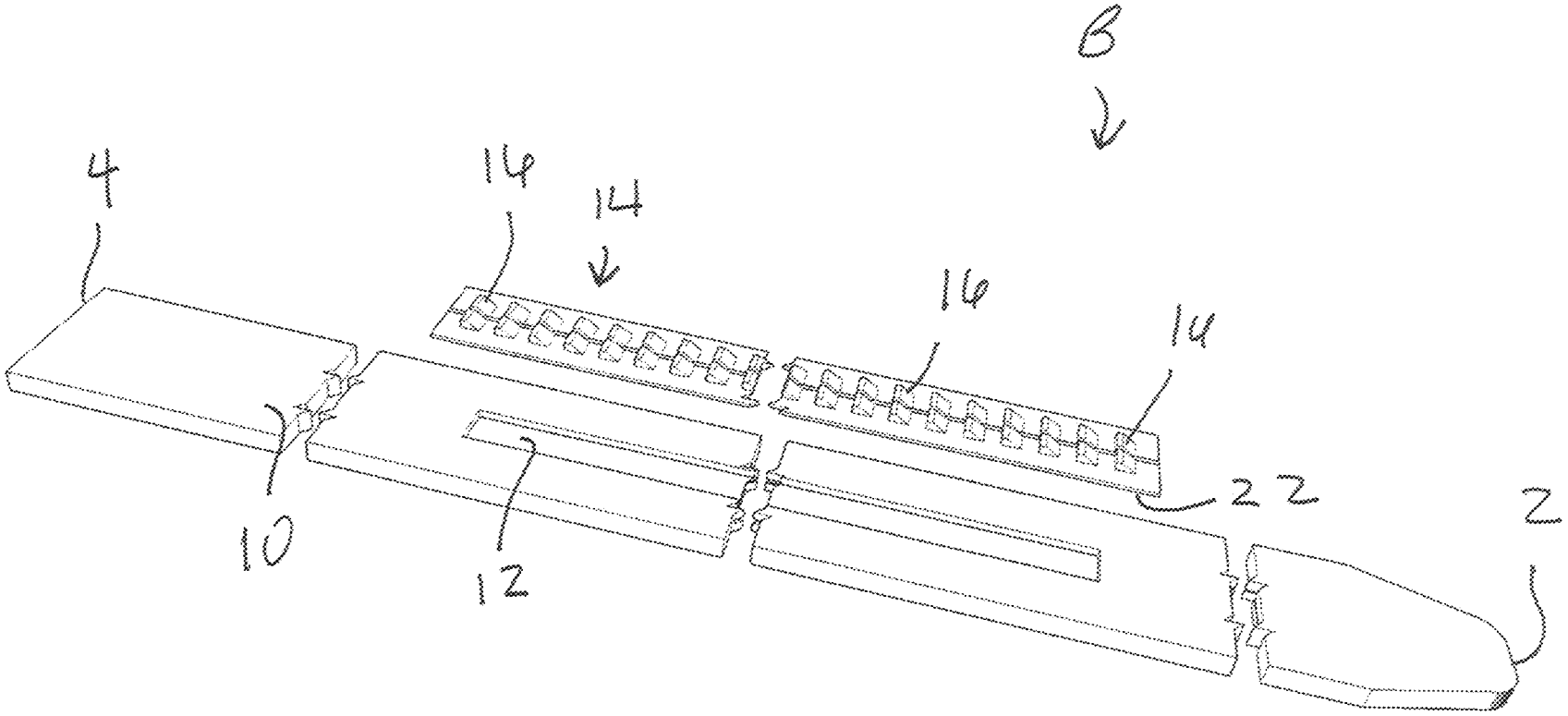
FIG. 3 is a partially exploded view of the belt strap of FIG. 2 showing the belt strap abutment strip removed from and disposed above the belt strap.

The preferred forms of the invention are described below with reference to FIGS. 1-10. The appended claims are not limited to the preferred forms and no term and/or phrase used herein is to be given a meaning other than its ordinary meaning unless it is expressly stated otherwise. The terms "engage," "engaged," and engaging" when used in connection with the relationship between one or more of the buckle abutment portions and one or more of the belt strap abutment portions means either direct contact or relative positioning (e.g., no direct contact) that when a belt having the belt buckle and the belt strap is worn by an individual acts to resist loosening of the belt strap.

The belt straps of the preferred forms of the present invention are designed to be used with a belt buckle having a main portion that includes two opposing closed loops and a body portion extending between and connecting the two closed loops with the body portion including one or more belt buckle abutment portions. In a most preferred embodiment, the belt straps of the preferred forms of the present invention are designed to be used with a belt buckle wherein the main portion of the belt buckle including the two opposing closed loops, the body portion and the one or more belt buckle abutment portions is formed so that no portion of the main portion of the belt buckle moves relative to the any other portion, section or segment of the main portion of the belt buckle. For example, the main portion of the belt buckle can be formed from a single piece of metal or any other suitable material.

The belt straps of the preferred forms of the present invention include a plurality of belt strap abutment portions configured to engage the at least one belt buckle abutment portion to connect the belt strap to the corresponding belt buckle. In a most preferred form, the plurality of belt strap abutment portions are formed in a non-metallic strip that can be formed from plastic, nylon or any other suitable material. The belt strap can be formed of one or more layers. For example, the belt strap can include an outer layer and inner layer that are sewn together. The inner layer preferably includes an opening having a similar configuration to the non-metallic strip to expose the plurality of belt strap abutment portions and permit connection with the at least one belt buckle abutment portion.

The belt straps of the present invention include an inadvertent disengagement prevention member ("IDPM") disposed adjacent the plurality of belt strap abutment portions. The IDPM is configured to prevent inadvertent loosening of the belt strap even when the wearer is engaging in strenuous activities. Specifically, the IDPM resists movement of a corresponding portion of the belt strap away from a corresponding portion of the belt buckle. Stated another way, the IDPM exerts a straightening force on a corresponding portion of belt strap to bias the corresponding portion of the belt strap toward a corresponding portion of the belt buckle to prevent inadvertent loosening of the belt strap. In a most preferred form, the IDPM is directly adjacent and in contact with an innermost portion of a non-metallic strip (e.g., plastic or nylon strip) having a plurality of belt strap abutment portions.

In a most preferred form, the IDPM includes one or more metal strips which can be removed from the belt strap and replaced with other metal strips to vary or alter the straightening or biasing force of the IDPM.

In one preferred form, the belt strap is provided with an access/insertion/removal area that allows an individual to insert one or more additional inadvertent disengagement prevention members to supplement those presently existing in the belt strap, remove one or more existing inadvertent disengagement prevention members and/or replace one or more existing inadvertent disengagement prevention members with one or more additional or new inadvertent disengagement prevention members to vary a force exerted on the belt strap abutment portions.

A removal facilitation member or element can be connected to the one or more of the metal strips to facilitate removal of the metal strip or strips.

In a most preferred embodiment, the IDPM is formed from high carbon spring steel and/or has a length of no greater than 12 inches, a thickness of 0.007 inches and a width of 0.5 inches. The belt strap of the preferred forms of the present invention can be used with belt buckles of the type disclosed in U.S. Pat. No. 10,932,529 or any other suitable belt buckle.

Preferred forms of the present invention completely eliminate the need for through holes extending completely through a belt strap to engage a movable prong of a belt buckle. Preferred forms of the present invention also completely eliminate the need for belt buckles having one or more moveable parts or components to secure a corresponding belt strap at a desired position. However, the preferred belt buckle does include a moveable release member that slides on a body of the belt buckle or otherwise moves relative to the belt strap to disengage the belt strap from the belt buckle to permit adjustment or removal of the belt.

The IDPM prevents inadvertent loosening of the belt strap without the need for the belt buckle to have one or more moveable parts or components to secure the belt strap at a desired position. In a most preferred form, the IDPM is formed from a very thin strip of metal located adjacent or in direct contact with a portion of the non-metallic strip having the plurality of belt strap abutment portions to exert sufficient force on the non-metallic strip to bias the one or more of the plurality of belt strap abutment portions into engagement with the at least one belt buckle abutment portion to prevent inadvertent loosening of the belt strap without adversely impacting the ability of a user to readily put the belt strap on (e.g., insert the belt strap through loops of pants, shorts, skirts, etc.) and connect the belt strap to a corresponding buckle.

In a most preferred form, the IDPM is formed from one or more strips of high carbon spring steel having a length no greater than 12 inches, a thickness of 0.007 inches and a width of 0.5 inches. The belt strap can be formed so that the IDPM is removable and replaced with another IDPM to alter the force exerted by the IDPM. For example, the thickness of the IDPM can be varied to alter or vary the force exerted by the IDPM.

While some preferred forms of the present invention are directed to belts to hold items of clothing about an individual in a desired position, the present invention is not limited to such belts and includes belts used to secure other articles including, but not limited to ornaments.

FIGS. 1 Through 7

Referring to FIGS. 1 to 7, preferred embodiments will be described which include a belt A having an adjustable belt strap B and a belt buckle C. The adjustable belt strap B includes a first end 2 and a second end 4 with the first end 2 forming a tip of the adjustable belt strap B and the second end 4 includes a belt buckle connector 6 that connects the second end 4 to a portion of the belt buckle C. The second end 4 can be connected to a portion of a belt buckle in any suitable manner including all known connection means or any subsequently developed connection means.

The adjustable belt strap B includes an outermost surface 8 (see, for example, FIG. 1) and an innermost surface 10 (see, for example, FIG. 2) with the innermost surface 10 being closer to an individual wearing belt A than outermost surface 8. The outermost surface 8 and the innermost surface 10 can be formed from separate pieces of material that are sewn together or are otherwise secured to each other. For example, referring to FIG. 4A, outermost surface 8 can be formed from a first layer of leather 9 and the innermost surface 10 formed from a second layer of leather 11. One or more cloth or fabric filler layers 13 (only one cloth or fabric layer is illustrated in FIG. 4A) may be sandwiched between the first leather layer 9 and the second leather layer 11 and secured thereto by stitching or any other suitable fastening means. However, any suitable material can be used to form the innermost surface 10 and the outermost surface 8, i.e., the belt strap B can be formed from one or more layers of any suitable material.

The innermost surface 10 includes a recess, opening or notch 12 in which a portion of strip 14 having a plurality of belt strap abutment portions 16 is disposed. If a filler layer or layers are used, any filler layer can also have a recess, notch or open area to accommodate strip 14 as is shown in FIG. 4A in which a portion of notch, recess or opening 15 is shown. Preferably, strip 14 is formed from a non-metallic material and most preferably is formed from plastic or nylon.

While strip 14 is preferably formed from a separate piece of material than the material forming the innermost surface 10 and outermost surface 8 of the belt strap B, the present invention is not limited to such. For example, the plurality of belt abutment portions 16 could be formed from the same piece of material forming innermost surface 10 with the outermost surface 8 being formed from a separate piece of material. Alternatively, the plurality of belt abutment portions 16 could be formed from the same piece of material forming the outermost surface 8 with the innermost surface 10 being formed from a separate piece of material.

Strip 14 can have a width and length greater than the width and length of recess 12 so that strip 14 can be sewn in place by stitching surrounding recess 12. However, strip 14 can be fixed in place by any suitable fastening means.

The adjustable belt strap B preferably includes an inadvertent disengagement prevention member 20 ("IDPM"). The IDPM 20 preferably is formed from a very thin piece of metal (e.g., high carbon spring steel). The IDPM 20 preferably is in direct contact with an inner surface 22 of strip 14 (see, for example, FIGS. 4A and 5). In a most preferred form, the IDPM 20 has a length no greater than 12 inches, a thickness of 0.007 inches and a width of 0.5 inches. However, the material and dimensions of the IDPM 20 can be varied as desired provided that the IDPM acts to prevent inadvertent loosening of the belt strap even when the wearer is engaged moving or engaged in other physical activities.

The IDPM 20 can be held in place by any suitable fastening means. For example, the metal strip can be secured in place by a notch or recess formed in the material forming the outermost surface or innermost surface of belt strap B. Alternatively, the IDPM 20 can be glued or otherwise fixed to inner surface 22 of strip 14.

Figure 4:
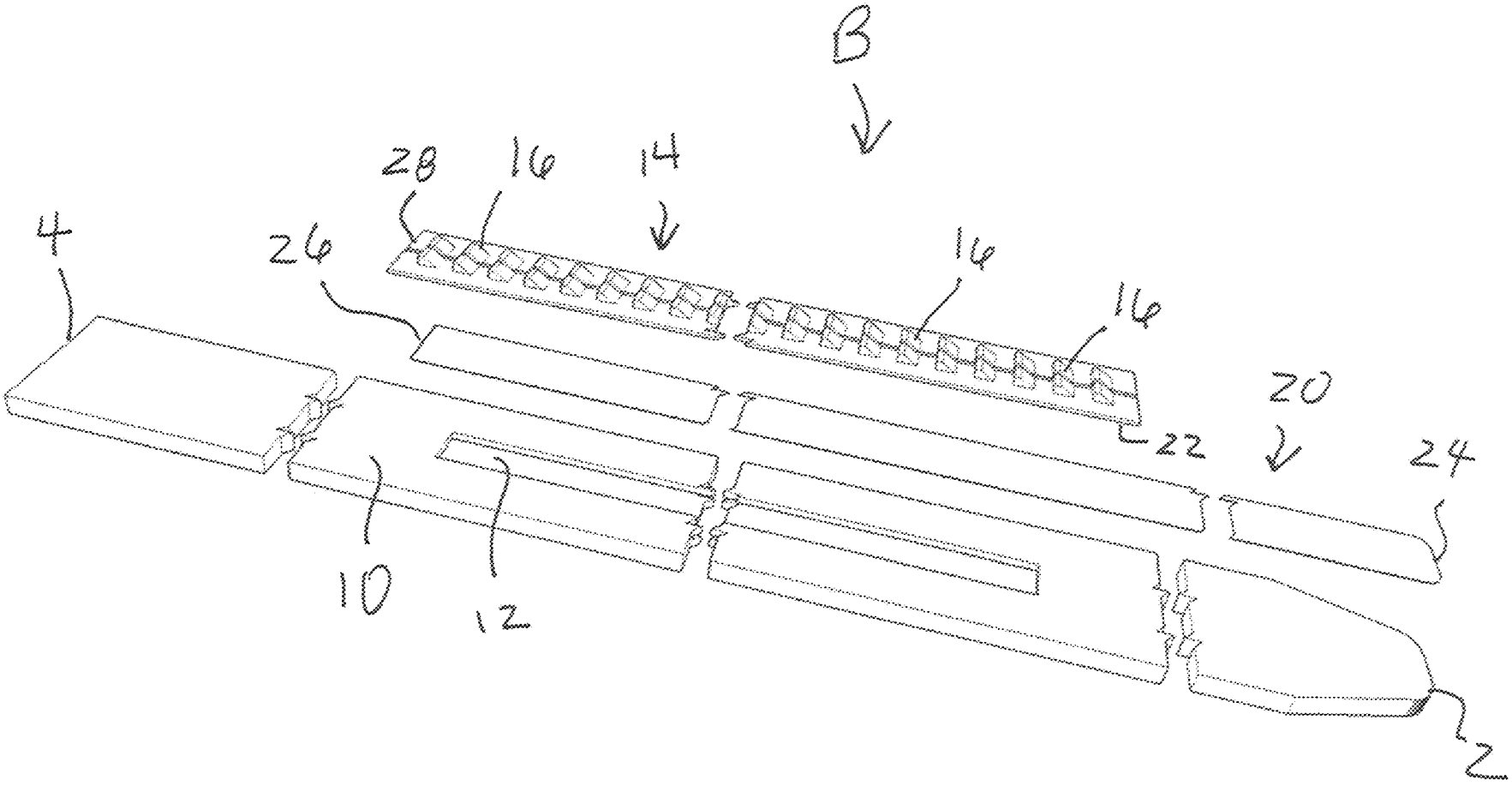
FIG. 4 is a partially exploded view of the belt strap of FIG. 2 showing the belt strap abutment strip and a preferred inadvertent disengagement prevention member removed from and disposed above the belt strap.
Figure 4A:
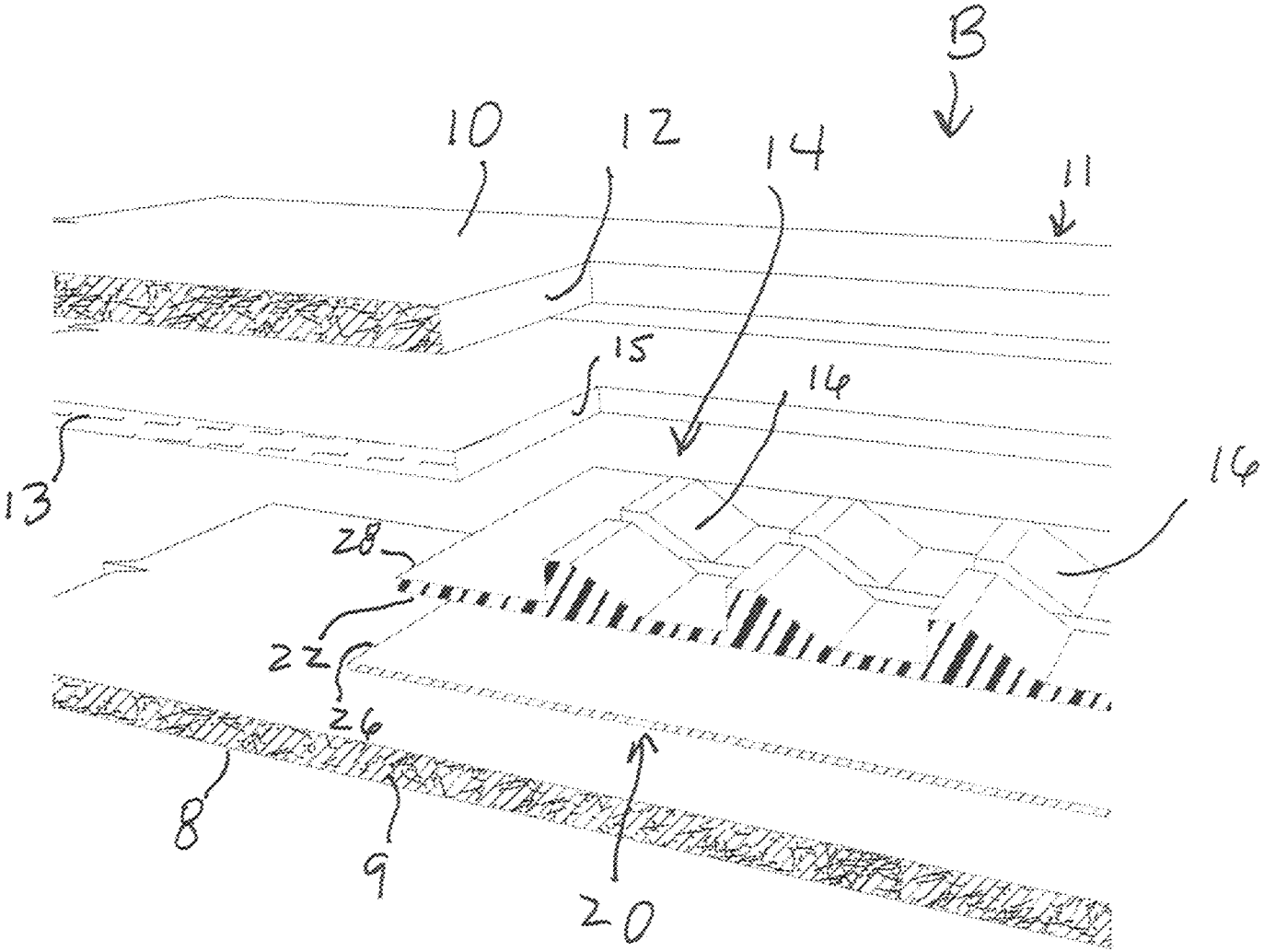
FIG. 4A is a fragmentary exploded view of a belt strap formed in accordance with a most preferred embodiment of the present invention having five layers including two leather outermost and innermost layers, a fabric or cloth filler layer, a non-metallic strip having a plurality of belt strap abutment portions and a metallic strip.
Figure 5:
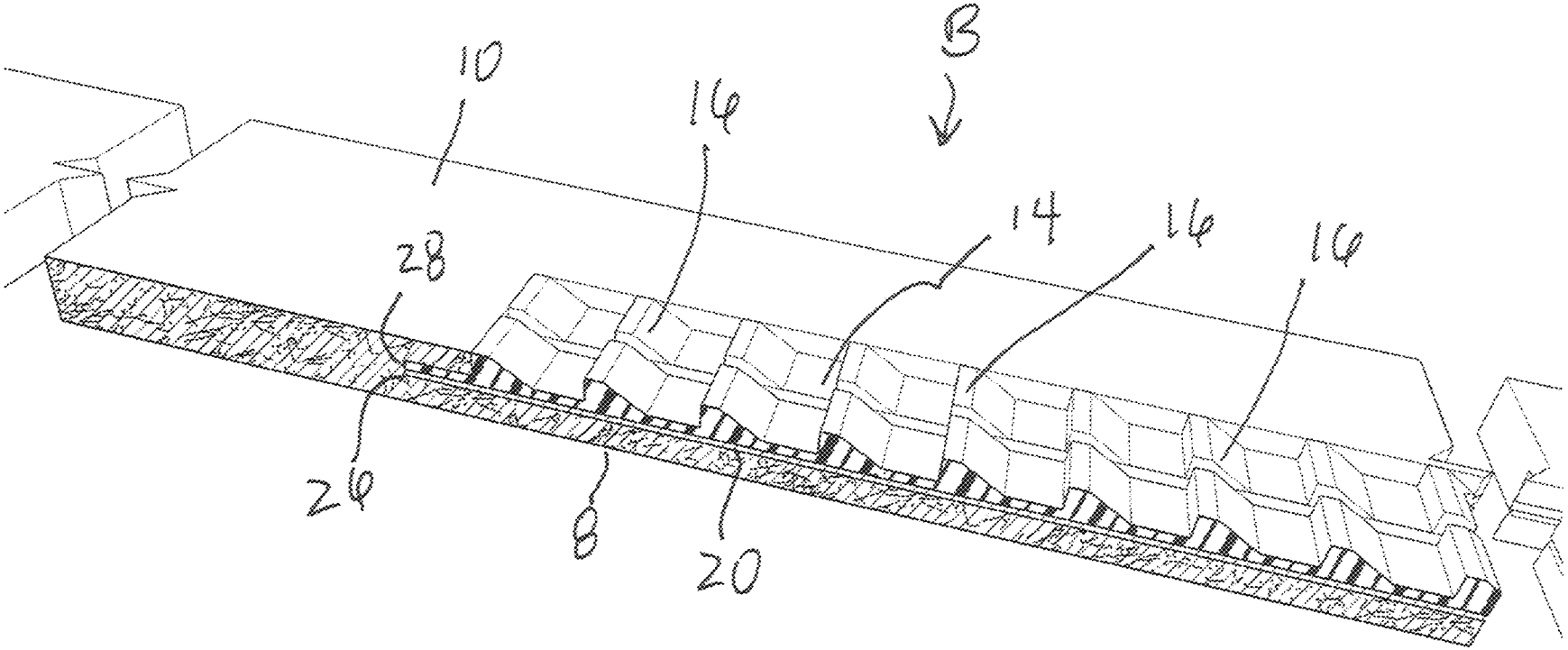
FIG. 5 is a fragmentary perspective sectional view of another preferred belt strap illustrating the belt strap abutment strip and one preferred inadvertent disengagement prevention member positioned between an interior surface (i.e., a surface between an outermost surface and innermost surface of the belt strap) of the belt strap abutment strip and the outermost surface of the belt strap.

As seen in FIG. 4, a first end 24 of the IDPM 20 can extend into tip 2 and a second end 26 of the IDPM 20 can terminate so that second end 26 is vertically aligned with an adjacent end 28 of strip 14 as seen in, for example, FIG. 5. While the second end 26 can be closer to end 4 of strap B than end 28 of strip 14, the length as well as the width and thickness of the IDPM 20 can be selected to minimize costs of manufacture provided the IDPM 20 is sized to serve the intended purpose of preventing inadvertent disengagement. For example, where strip 14 has a length that is 50% or less of the length of the belt strap B, the IDPM 20 could have a length that is 50% or less of the length of strap B (i.e., the IDPM 20 could extend only a minor portion of strap B where strip 14 extends only a minor portion of strap B). Preferably, the width of IDPM 20 is greater than or equal to the width of belt strap abutment portions 16 so that the IDPM 20 acts across the entire width of the belt strap abutment portions 16. As seen in, for example FIG. 4, the preferred form of strip 14 has a width greater than the width of the belt strap abutment portions 16.

Figure 6:
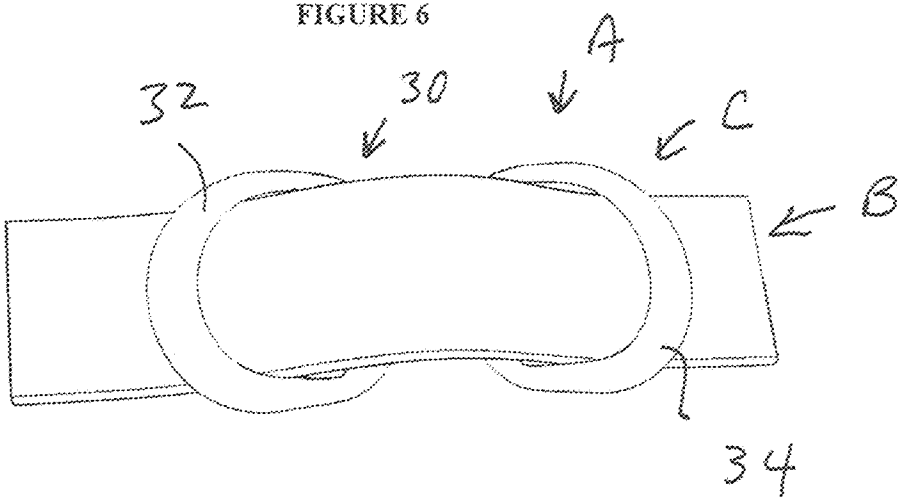
FIG. 6 is a fragmentary perspective view of a portion of a preferred belt strap extending through opposing closed looped ends of a corresponding belt buckle.
Figure 7:
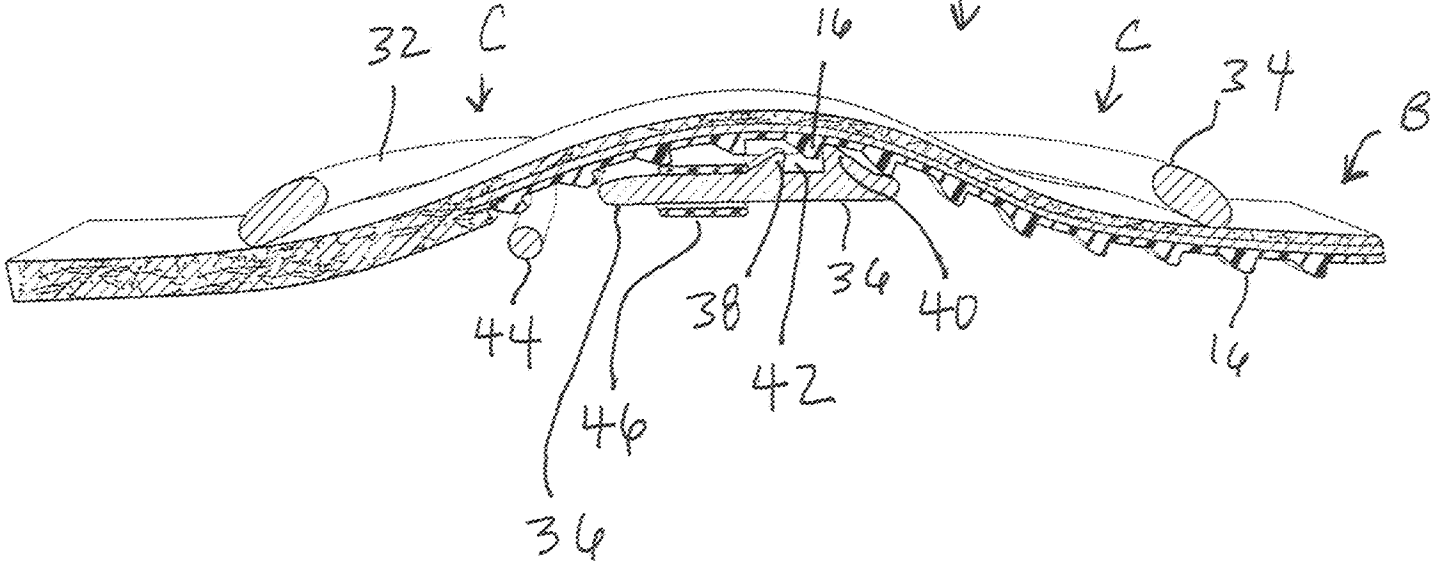
FIG. 7 is an enlarged perspective sectional view of FIG. 8 illustrating engagement of a belt strap abutment portion with or between two opposing belt buckle abutment portions wherein the body of the belt buckle including the two opposing belt buckle abutment portions and the opposing closed looped ends are formed from a single piece of material (e.g., metal).

Referring to FIGS. 6 and 7, belt buckle C preferably includes a main portion 30 that includes a first closed looped end 32, a second closed looped end 34 and a body portion 36 connecting the first closed looped end 32 to the second closed looped 34. The body 36 preferably includes a first buckle abutment portion 38 and a second buckle abutment portion 40. The first buckle abutment portion 38 is spaced from the second buckle abutment portion 40 creating a recess, depression or notch 42 therebetween to receive a corresponding one of the plurality of belt strap abutment portions 16 as seen in FIG. 7. Buckle C further includes a belt strap attachment member 44 configure to connect with connector 6 of belt strap B to buckle C. However, any other suitable means can be used to connect end 4 of strap B to buckle C.

Buckle C preferably includes a moveable release member 46 that can be used by an individual to readily detach the belt strap B from buckle C as described in U.S. Pat. No. 10,932,529. As shown in FIG. 7, moveable release member 46 is clipped on to body portion 36 and can be moved horizontally on body portion 36 toward recess 42 to disengage belt strap B from buckle C.

The IDPM is specifically configured to prevent inadvertent loosening of the belt strap without the need for the belt buckle to have one or more moveable parts or components to secure the belt strap at a desired position even where the user is engaging in strenuous physical activities.

Forming the IDPM 20 from a very thin strip of metal provides a sufficient force to be exerted on the strip 14 to bias the one or more of the plurality of belt strap abutment portions 16 into the recess 42 formed between belt buckle abutment portions 38 and 40 to prevent inadvertent loosening of the belt strap without adversely impacting the ability of a user to readily put the belt strap B on (e.g., insert the belt strap through loops of pants, shorts, skirts, etc.) and connect the belt strap B to a buckle C. In fact, the user will likely not know that the IDPM 20 even exists as the IDPM 20 preferably is completely encased so that it cannot be seen without dismantling the belt strap B.

Figure 8:
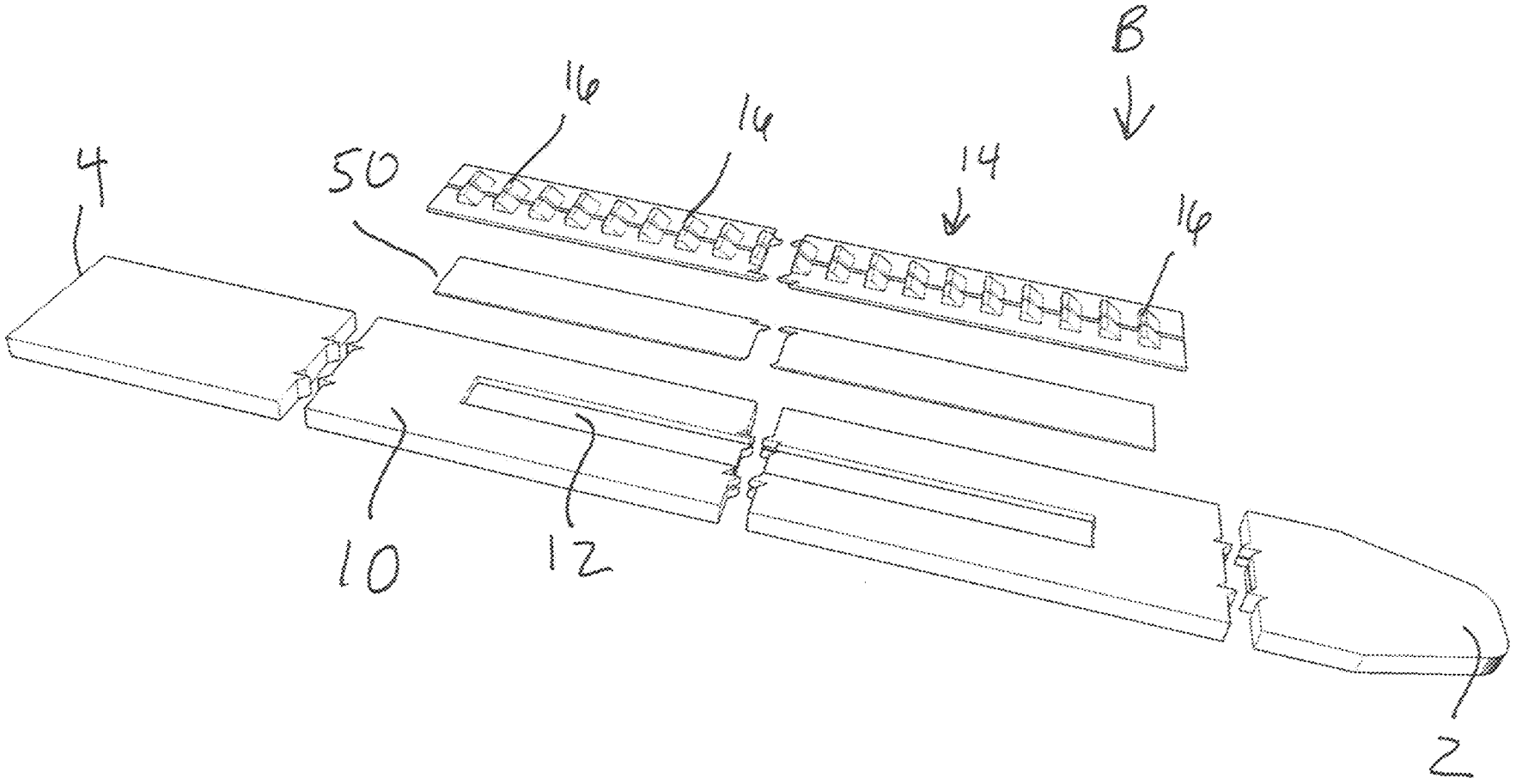
FIG. 8 is a view similar to FIG. 4 with the belt strap abutment strip and another preferred inadvertent disengagement prevention member removed from and disposed above the belt strap.
Figure 9:
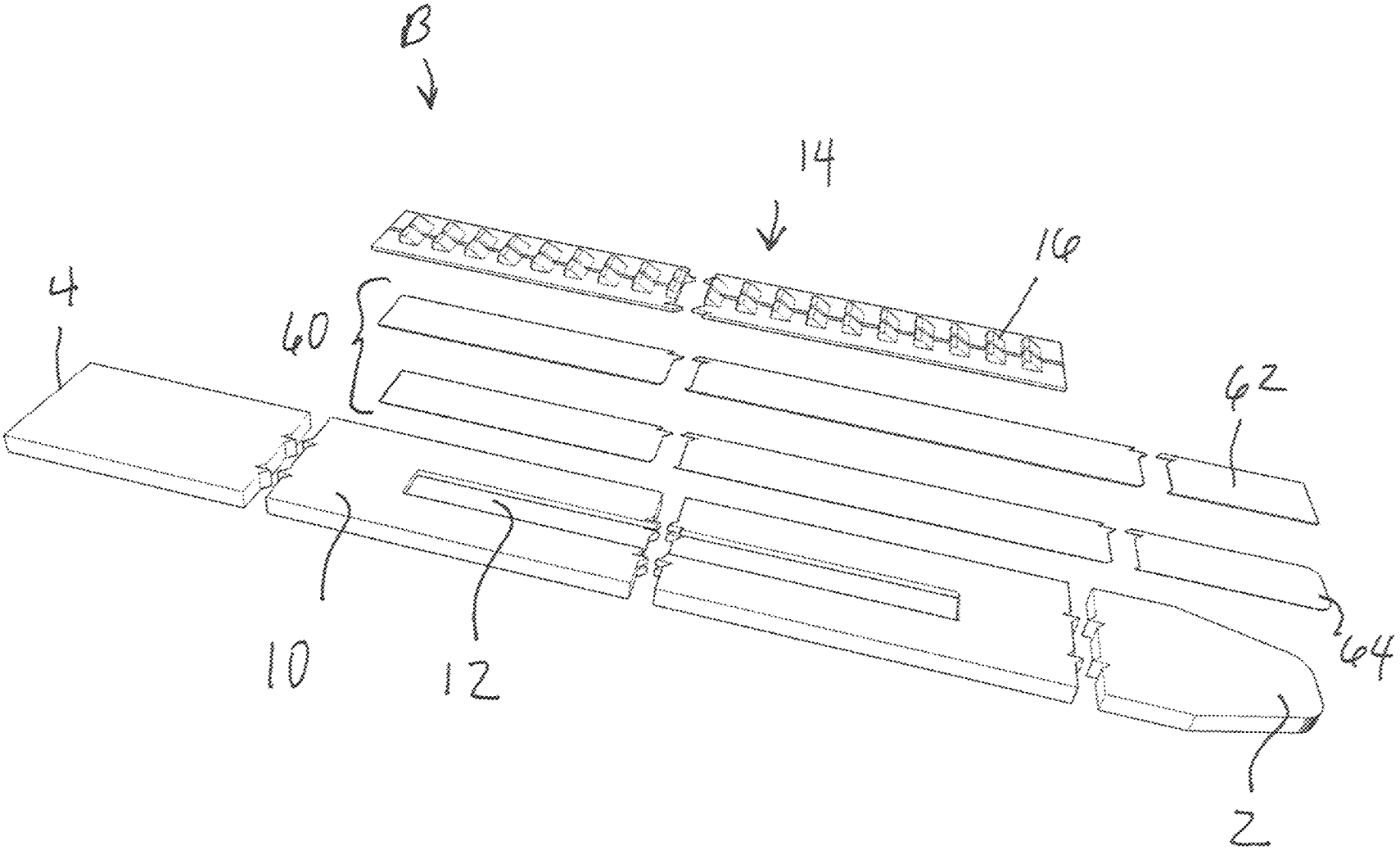
FIG. 9 is a view similar to FIG. 4 with the belt strap abutment strip and a further preferred inadvertent disengagement prevention member removed from and disposed above the belt strap.
Figure 10:
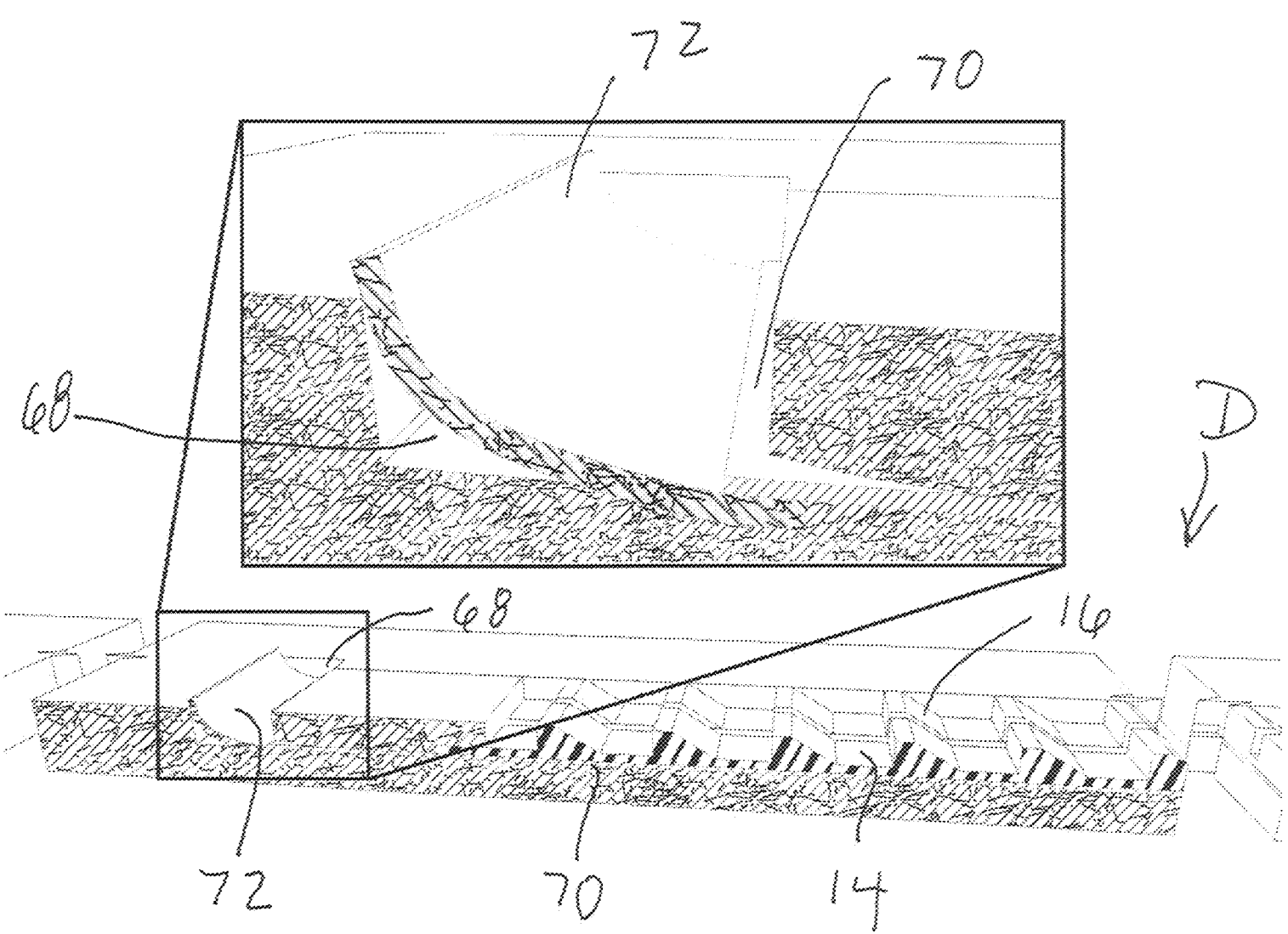
FIG. 10 is a fragmentary perspective sectional view of an alternative belt strap with an access pocket (e.g., a recess, notch or depression) formed in the belt strap allowing an individual to remove and/or replace a preferred inadvertent disengagement prevention member by manipulating (e.g., pulling on) a preferred removal facilitation member secured or fixed to an end of the preferred inadvertent disengagement prevention member.

FIGS. 8 Through 10

Additional embodiments will now be described with reference to FIGS. 8 to 10. The additional embodiments are similar to the embodiments described above and, therefore, only the differences will be described in detail. Referring to FIG. 8, IDPM 50 has a length less than the length of IDPM 20 so that IDPM 50 does not extend into tip 2. Referring to FIG. 9, IDPM 60 is formed from two metals strips 62 and 64 identical to the single strip of IDPM 20. However, strips 62 and 64 can be configured differently from each other and the single strip of IDPM 20 to vary the force applied to strip 14.

Referring to FIG. 10, a further alternative embodiment will now be described. In this embodiment, belt strap D includes an access area 68 to allow for insertion, removal and replacement of one or more metal strips 70 that form the IDPM. In this embodiment, one or more the metal strips 70 are not fixed to any other portion of the belt strap D but are held in place by friction forces or other forces that exist due to the construction of the belt strap D including the forces that existing due to stitching multiple layers together. A removal facilitation member 72 can be fixed to the each of the one or more strips 70 (e.g., gluing or any other suitable fastening means). As seen in FIG. 10, a free end of removal facilitation member 72 can be readily accessed by an individual to allow for removal of the one or more strips 70 through access area 68. The access area 68 also allows an individual to add one or more metal strips to supplement any metal strip or strips already present in strap D. The access area 68 and removal facilitation member 72 allow an individual to readily remove and replace any existing metal strips with one or more new and different metal strips to vary or adjust the force exerted on strip 14.

While this invention has been described as having preferred designs, it is understood that the each and every preferred design can be further modified or adapted following in general the principles of the invention and including, but not limited to such departures from the present invention as come within the known or customary practice in the art to which the invention pertains. The claims are not limited to the preferred embodiments and have been written to preclude such a narrow construction using the principles of claim differentiation.

I claim:

1. An apparatus for securing an article worn by an individual, said apparatus comprising:

(a) an adjustable belt strap including a first end and a second end wherein the first end forms a tip of the adjustable belt strap and the second end is configured to be connected to a portion of a belt buckle wherein the adjustable belt strap is free of any hole extending completely through the adjustable belt strap;

(b) the adjustable belt strap including a plurality of belt strap abutment portions configured to engage at least one buckle abutment portion of the belt buckle to prevent the adjustable belt strap from being inadvertently loosened; and, (c) said adjustable belt strap including an inadvertent disengagement prevention member for preventing a corresponding belt strap abutment portion from inadvertently disengaging from the at least one buckle abutment portion of the belt buckle to prevent the inadvertent loosening of the adjustable belt strap when worn by an individual, wherein the corresponding belt strap abutment portion is positioned between the inadvertent disengagement prevention member and the at least one buckle abutment portion.

2. The apparatus of claim 1, wherein:

(a) the inadvertent disengagement prevention member is disposed between an outer surface of the adjustable belt strap and the plurality of belt strap abutment portions.

3. The apparatus of claim 1, wherein:

(a) the plurality of belt strap abutment portions are formed on a non-metallic strip having a first end and a second end, the first end of the non-metallic strip being positioned closer to the tip of the adjustable belt strap than the second end of the non-metallic strip; and, (b) said inadvertent disengagement prevention member having a first end and a second end, said first end of said inadvertent disengagement prevention member being vertically aligned with the second end of the non-metallic strip.

4. The apparatus of claim 1, wherein:

(a) the plurality of belt strap abutment portions are formed on a non-metallic strip having a first thickness and the inadvertent disengagement prevention member having a second thickness wherein the first thickness of the non-metallic strip is greater than the second thickness of the inadvertent disengagement prevention member.

5. The apparatus of claim 1, wherein:

(a) the inadvertent disengagement prevention member has a length that is less than 50 percent of a length of said adjustable belt strap.

6. The apparatus of claim 5, wherein:

(a) the inadvertent disengagement prevention member has a length of no greater than 12 inches, a thickness of 0.007 inches and a width of 0.5 inches.

7. The apparatus of claim 1, wherein:

(a) the inadvertent disengagement prevention member is disposed in said adjustable belt strap so that the inadvertent disengagement prevention member can be removed from the adjustable belt strap.

8. The apparatus of claim 7, wherein:

(a) said adjustable belt strap includes an access notch or recess configured to allow a user to access an end of the inadvertent disengagement prevention member to remove the inadvertent disengagement prevention member from the adjustable belt strap.

9. The apparatus of claim 1, wherein:

(a) the inadvertent disengagement prevention member is a thin flat plate.

10. The apparatus of claim 1, further including:

(a) a belt buckle connected to the second end of the adjustable belt strap, said belt buckle having a body extending between a first closed looped belt buckle end and a second closed looped belt buckle end, each of the first closed looped belt buckle end and the second closed looped belt buckle end being configured to allow a corresponding portion of the adjustable belt strap to be inserted therethrough, the at least one buckle abutment portion being fixed on said body so that the at least one buckle abutment portion cannot move relative to any of said body, the first closed looped belt buckle end and the second closed looped belt buckle.

11. An adjustable belt for securing an article of clothing about a waist of an individual, said adjustable belt including:

(a) a belt strap including a free end, a connection end and an inner surface having a plurality of belt strap abutment portions, the belt strap being free of through holes;

(b) a belt buckle having at least one buckle abutment portion formed on a body of said belt buckle, and, (c) said belt strap including an inadvertent disengagement prevention member for preventing inadvertent disengagement of one or more of the plurality of belt strap abutment portions from the at least one buckle abutment portion of said belt buckle by biasing the one or more of the plurality of belt strap abutment portions of said belt strap into engagement with the at least one buckle abutment portion of said buckle, wherein no portion of the inadvertent disengagement prevention member directly contacts any portion of the belt buckle.

12. The adjustable belt of claim 11, wherein:

(a) the at least one buckle abutment portion is fixed on said body of said belt buckle so that the at least one buckle abutment portion cannot move relative to said body of said belt buckle.

13. The adjustable belt of claim 12, wherein:

(a) the inadvertent disengagement prevention member is removable to allow for removal of the inadvertent disengagement prevention member and insertion of a second inadvertent disengagement prevention member to vary a biasing force exerted on a corresponding portion of the belt strap.

14. The adjustable belt of claim 13, wherein:

(a) the inadvertent disengagement prevention member is a metal strip having a first end and a second end.

15. The adjustable belt of claim 14, wherein:

(a) the plurality of belt strap abutment portions are formed on a non-metallic strip having a first end and a second end, the first end of the non-metallic strip being positioned closer to a tip of the adjustable belt strap than the second end of the non-metallic strip; and, (b) said first end of the metal strip being vertically aligned with the second end of the non-metallic strip.

16. The adjustable belt of claim 15, wherein:

(a) the metal strip has a length of no greater than 12 inches, a thickness of 0.007 inches and a width of 0.5 inches.

17. The adjustable belt of claim 16, wherein:

(a) the belt strap includes a pocket adjacent a first end of the metal strip to facilitate removal of the metal strip.

18. An apparatus, comprising:

(a) a belt strap including a first end and a second end wherein the first end forms a tip of the belt strap and the second end is configured to be connected to a portion of a belt buckle;

(b) the belt strap including a plurality of belt strap abutment portions configured to engage at least one buckle abutment portion of the belt buckle so that the belt strap is maintained in a desired position when worn by an individual; and, (c) said belt strap including a metal strip for biasing the at least one of the plurality of belt strap abutment portions into engagement with the at least one buckle abutment portion of the belt buckle to prevent inadvertent loosening of the adjustable strap wherein the metal strip is disposed between an outermost surface of the adjustable belt strap and an innermost surface of the adjustable belt strap so that the metal strip does not directly contact any portion of the belt buckle when the belt strap is worn by an individual.

19. The apparatus of claim 18, wherein:

(a) the metal strip has a length of no greater than 12 inches, a thickness of 0.007 inches and a width of 0.5 inches.

20. The apparatus of claim 18, wherein:

(a) the plurality of belt strap abutment portions are formed on a non-metallic strip having a first end and a second end, the first end of the non-metallic strip being positioned closer to a tip of the adjustable belt strap than the second end of the non-metallic strip; and, (b) a first end of the metal strip being vertically aligned with the second end of the non-metallic strip and a second end of the metal strip is positioned closer to the first end of the non-metallic strip than the second end of the non-metallic strip.

* * * * *